US011621104B1

(12) United States Patent
Lesko

(10) Patent No.: US 11,621,104 B1
(45) Date of Patent: Apr. 4, 2023

(54) DIFFERENTIAL MODE ELECTRICAL CABLE TO REDUCE SONAR TOWED ARRAY SELF-NOISE ELECTRONICALLY

(71) Applicant: Susan Lesko, Elburn, IL (US)

(72) Inventor: Matthew M. Lesko, Elburn, IL (US)

( * ) Notice: Subject to any disclaimer, the term of this patent is extended or adjusted under 35 U.S.C. 154(b) by 3 days.

(21) Appl. No.: 17/367,808

(22) Filed: Jul. 6, 2021

Related U.S. Application Data

(63) Continuation-in-part of application No. 17/025,074, filed on Sep. 18, 2020, now Pat. No. 11,532,409.

(60) Provisional application No. 62/903,294, filed on Sep. 20, 2019.

(51) Int. Cl.
*H01B 11/18* (2006.01)
*H01B 7/282* (2006.01)
*H01B 7/14* (2006.01)

(52) U.S. Cl.
CPC ..... *H01B 11/1895* (2013.01); *H01B 7/14* (2013.01); *H01B 7/282* (2013.01)

(58) Field of Classification Search
CPC ..... H01B 11/1895; H01B 7/14; H01B 7/282
See application file for complete search history.

(56) References Cited

U.S. PATENT DOCUMENTS 5,764,061 A * 6/1998 Asakawa ..... G01V 3/02 324/365
6,577,187 B1 6/2003 Lesko
7,314,997 B1 * 1/2008 Mui ..... H01B 11/04 174/36
11,408,986 B1 * 8/2022 Huang ..... H04R 1/44
2013/0197810 A1 * 8/2013 Haas ..... E21B 47/113 702/6
2015/0168564 A1 * 6/2015 Hooten ..... G01T 1/1603 378/98
2019/0169976 A1 * 6/2019 Wheater ..... E21B 17/10

* cited by examiner

*Primary Examiner* — Timothy J Thompson
*Assistant Examiner* — Rhadames Alonzo Miller
(74) *Attorney, Agent, or Firm* — Malin Haley DiMaggio & Bowen, P.A.

(57) ABSTRACT

A differential mode instrumentation cable for improving the signal integrity of audio signals in different environments including use of a sonar hydrophone being towed to the water behind a ship and the sonar hydrophone signal receiver aboard ship to improve the hydrophone signal receiver signal output clarity, reducing strumming cable noises, comprising a first triaxial cable and a second triaxial cable, placed side-by-side, and surrounded by waterproof cable material fr to prevent any water from reaching the first and second triaxial cable from end to end from the hydrophone to the signal receiver aboard ship and mounted together, said first coaxial cable and said second coaxial cable including a wired connection that includes an active driven shield buffer circuit in each triaxial cable having an inner conductor for voltage in from the positive polarity and minus polarity and the voltage out driven guard shield with series breakout resistor connected to the each triaxial inner shield.

3 Claims, 11 Drawing Sheets

2.5, 3.5 and 6.35 mm TRS phone plugs 3-pin XLR connectors, female on left and male on right 3-pin XLR + 6.35 mm TRS phone hybrid jack.

DIFFERENTIAL MODE ELECTRICAL CABLE TO REDUCE SONAR TOWED ARRAY SELF-NOISE ELECTRONICALLY

RELATED PATENT APPLICATIONS

Continuation-In-Part Application of U.S. patent application Ser. No. 17/025,074, filed Sep. 18, 2020 that claims the benefit of Provisional Ser. No. 62/903,294 filed on Sep. 20, 2019

BACKGROUND OF THE INVENTION

1. Field of the Invention

This invention relates to an improved triaxial noise reducing cable and circuitry for connecting a sonar hydrophone, being towed behind a ship, to an audio sonar signal receiver aboard the ship. The electrical audio signal sonar triaxial cable has its input from a SONAR hydrophone, being towed behind a ship, to reduce towed array self-noise, also known as cable strum, electronically to improve the signal strength to a sonar receiver aboard the towing ship.

The invention is comprised of two triaxial cables, mounted side-by-side, enclosed in a waterproof sealed cable enclosure from end to end, each triaxial cable having an inner conductor connected, at one end, to the positive and negative input of a hydrophone being towed, the output of which is connected to a sonar audio signal receiver mounted aboard the towing ship.

One triaxial cable inner conductor input end connects to a positive polarity of the hydrophone sensor input, and the other side by side triaxial cable inner conductor input end connects to the hydrophone negative sensor input. Both triaxial cables' inner conductor outputs, throughout the entire signal chain, end up connected to a hydrophone audio signal receiver, aboard the towing ship, capturing sounds in the water, while towed behind a ship, using amplifier circuitry, transmitting the audio or transducer signals throughout the entire signal chain, with reduced noise.

2. Description of Related Art

Non-acoustic self-noise observed on marine seismic streamers and towed sonar arrays represent a serious problem for acoustic source detection at low frequency. Towed array self-noise, also known as cable strum, consists of mechanical vibrations induced by vortex shedding. Transverse vibrations in the array body subject each hydrophone pressure head to local accelerations. The resultant acoustic response can be several orders of magnitude stronger than the water-borne acoustic signals of interest.

The present invention provides hermetically sealed triaxial cables, side-by-side, that are connected at one end to the hydrophone output being towed in the water and at the other end to the sonar receiver aboard ship listening for sonar signals. The present invention removes cable strum to increase the sensitivity of the hydrophone signals received by the sonar receiver.

There are several U.S. patents that show attempted mechanical suppression of cable strumming by rigid cable jackets that are used to tow the hydrophone attached at one end to a ship attached at the other end. U.S. Pat. No. 5,275,120 discloses a" strum-suppressant cable for towed arrays", that uses tabs in the helical pattern to suppress noise mechanically U.S. Pat. No. 3,884,173 issued May 20, 1975 "entitled "Suppression of cable strumming vibration by rigid cable jacket". Also U.S. Pat. No. 4,190,012 issued Feb. 26, 1980 shows a "faired tow cable with stubs for strum reduction". U.S. Pat. No. 3,369,599 shows a cable fairing system that contains a rotatable cable to reduce strum. The noise reducing cables shown are mechanical and attempt to reduce unwanted noise using mechanical means without addressing the electrical signal that represents an electrical audio signal from a hydrophone to the sonar receiver aboard ship. Applicant's invention herein reduces the mechanical noise of strum electronically with a pair of triax cables described herein. Thus using Applicant's invention, there are two shipborne different cables connected at one end to the hydrophone being towed in the water and at the opposite end to the ship, one mechanical cable being mechanical to secure the hydrophone to the ship and the other cable array being Applicant's invention which is the electrical cable to gather and transfer the sonar passive signal output of the hydrophone to the sonar receiver aboard ship, which is the purpose of sonar to listen, thereby making the sensitivity of the sonar receiver extremely important.

Improving the signal integrity of audio or instrumentation signals in a variety of different environments including SONAR listening devices towed behind ships, use of microphones, guitar cables, speaker cables, audiophile cables and analog audio balanced/differential tie lines in multi-room studios has long been important signal integrity goals for people that are involved in the production of audio practical and entertainment content.

One source of audio or instrumentation signal distortion and noise has been involved with the audio or instrumentation cables used to transfer audio or instrumentation signals from a source such as a microphone or instrumentation sensor to a desired output. Conventional cable has been used traditionally utilized in various environments which has been plagued with signal integrity issues regarding with degradation regarding the cable's low-pass filter effects due to dielectric absorption and triboelectric (handling noise) effects via inherent capacitance.

Microphone noise reduction has been found also in applications to affect the microphone preamplifier to eliminate audio signal distortion. An Example is found in U.S. Pat. No. 6,577,187 issued to Matthew Lesko inventor in 2003.

Applicant has determined that a solution for greatly enhancing audio signal integrity can be found using two triaxial cables, joined together, eliminating low-pass filter and dielectric absorption effects when the capacitance and conductance are referenced to the guard not to the shield.

SUMMARY OF THE INVENTION

A differential mode instrumentation cable for improving the signal integrity of sonar audio signals received from a towed hydrophone, behind the ship, in a shipboard sonar sound receiver .invention is used in in a variety of different environments including the use of connecting a sonar hydrophone to a sonar receiver aboard ship, at both ends of the entire signal chain, comprising a first triaxial cable mounted side-by-side to a second triaxial cable, said first triaxial cable and second triaxial cable each having an inner conductor, a dialectic core, an inner shield, an interlayer, and an outer shield. In a sonar environment the first and second the two triax cables of the invention are hermetically-sealed (waterproof) to prevent water from interfering with the two side-by-side triax cables along its entire length from the hydrophone being towed in the water at one end of the triax cables until its opposite end of the Triax cables are aboard ship and connected to a sonar audio receiver.

The first triaxial cable and the second triaxial cable each have a buffer amplifier circuit at the load end connected to each cable inner conductor. Each triaxial cable is connected to the positive input the buffer amplifier. The buffer amplifier output goes to each triaxial cable's inner shield through a resistor output connected to each triaxial cable inner shield.

Differential signaling of the invention is having the inner conductor of each triaxial cable transmitting the same signal at opposite polarity. Therefore the first triaxial cable is connected to the positive polarity output of the input microphone or instrumentation sensor and the second triaxial cable is connected to the negative polarity contact output from the microphone or instrumentation sensor.

The differential mode instrumentation cable comprising the first triaxial cable and the second triaxial cable, joined together (side-by-side), has a first triaxial inner conductor input end and a second triaxial inner conductor input end for a device such as a sonar hydrophone, a sonar hydrophone shipboard receiver sensor and a first triaxial cable inner conductor output end and a second triaxial inner conductor output end for a device such as a passive/active sonar receiver. Other instrumentation uses are possible. The differential mode instrumentation cable can be of extended length for use in connecting a microphone or instrumentation sensor as the input and the audio or instrumentation output can be a passive/active speaker. Therefore, the inner conductor of first triaxial cable and the inner conductor of the second triaxial cable together provide the connection between microphone or instrumentation sensor throughout the entire signal chain to the passive/active speaker.

The first triaxial cable and the second triaxial cable shall be provided with appropriate input jacks for the positive and negative sonar hydrophone and hydrophone signal receiver sensor output connectors and an appropriate output jacks that would be connectable to an output to the passive/active sonar equipment. The first triaxial cable and the second triaxial cable outer shields will also be connected to the ground.

It is an object of this invention to improve the signal integrity of audio signals in different environments that can include a sonar hydrophone being towed behind the ship, improving the audio signals received from the hydrophone into a sonar receiver aboard ship, microphones, guitar cables, speaker cables, audiophile cables and analog audio balanced/differential tie lines, utilized in multi-room studios using a differential mode instrumentation cable comprising a first triaxial cable and a second triaxial cable, joined together side-by side, each triaxial cable including its own buffered amplifier output, through a resistor, to its own inner shield, reducing noise for audio or instrumentation signal transfer.

BRIEF DESCRIPTION OF THE DRAWINGS

FIG. 1, bottom picture, shows a solution using a triaxial cable, eliminating low-pass filter and dielectric absorption effects because capacitance and conductance are referenced to the guard not the shield.

FIG. 6 shows a triaxial conductive wire with a center conductor in her braid which is a guard in another braid which is a shield.

PREFERRED EMBODIMENTS OF THE INVENTION

Figure 18:
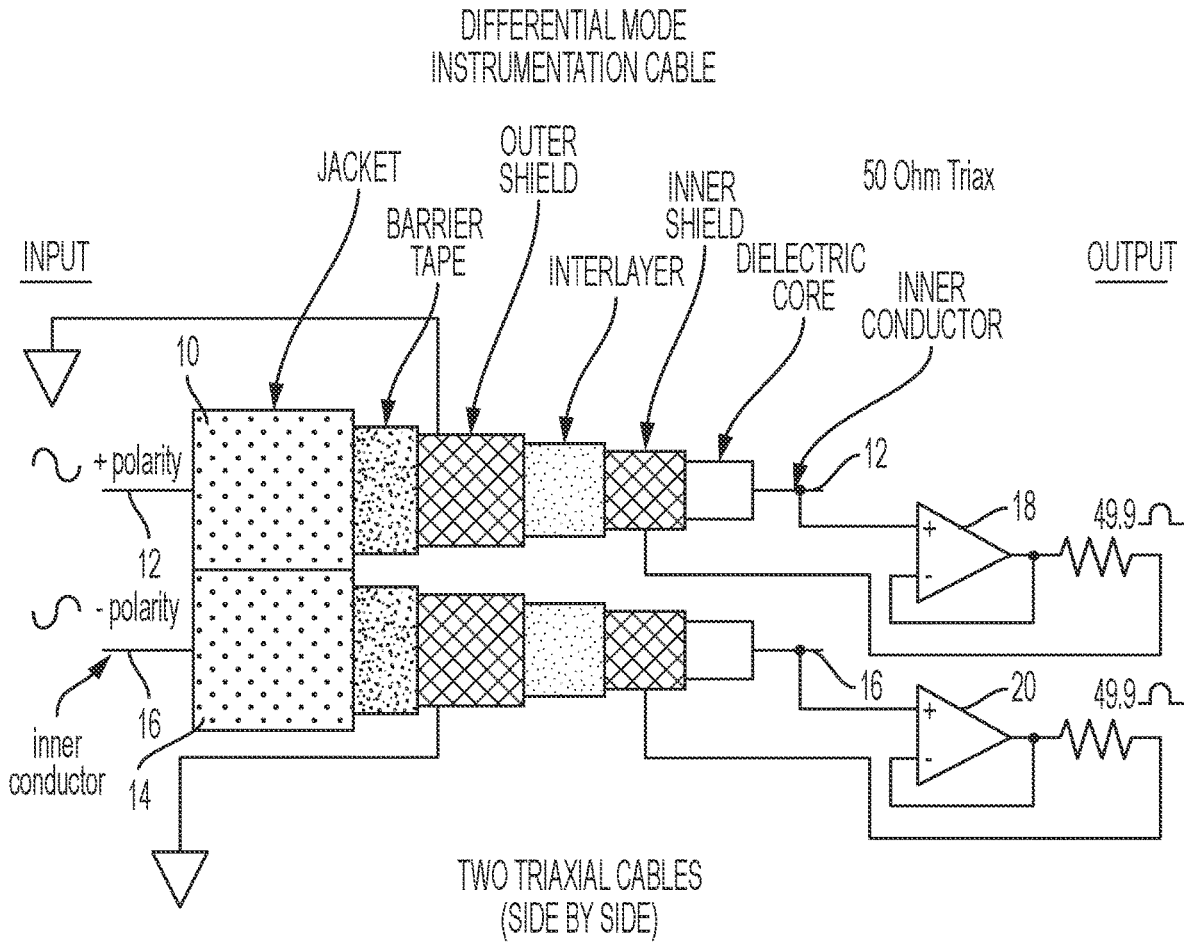
FIG. 18 shows a schematic diagram of the present invention that includes two triaxial cables and the appropriate differential mode circuitry.
Figure 18A:
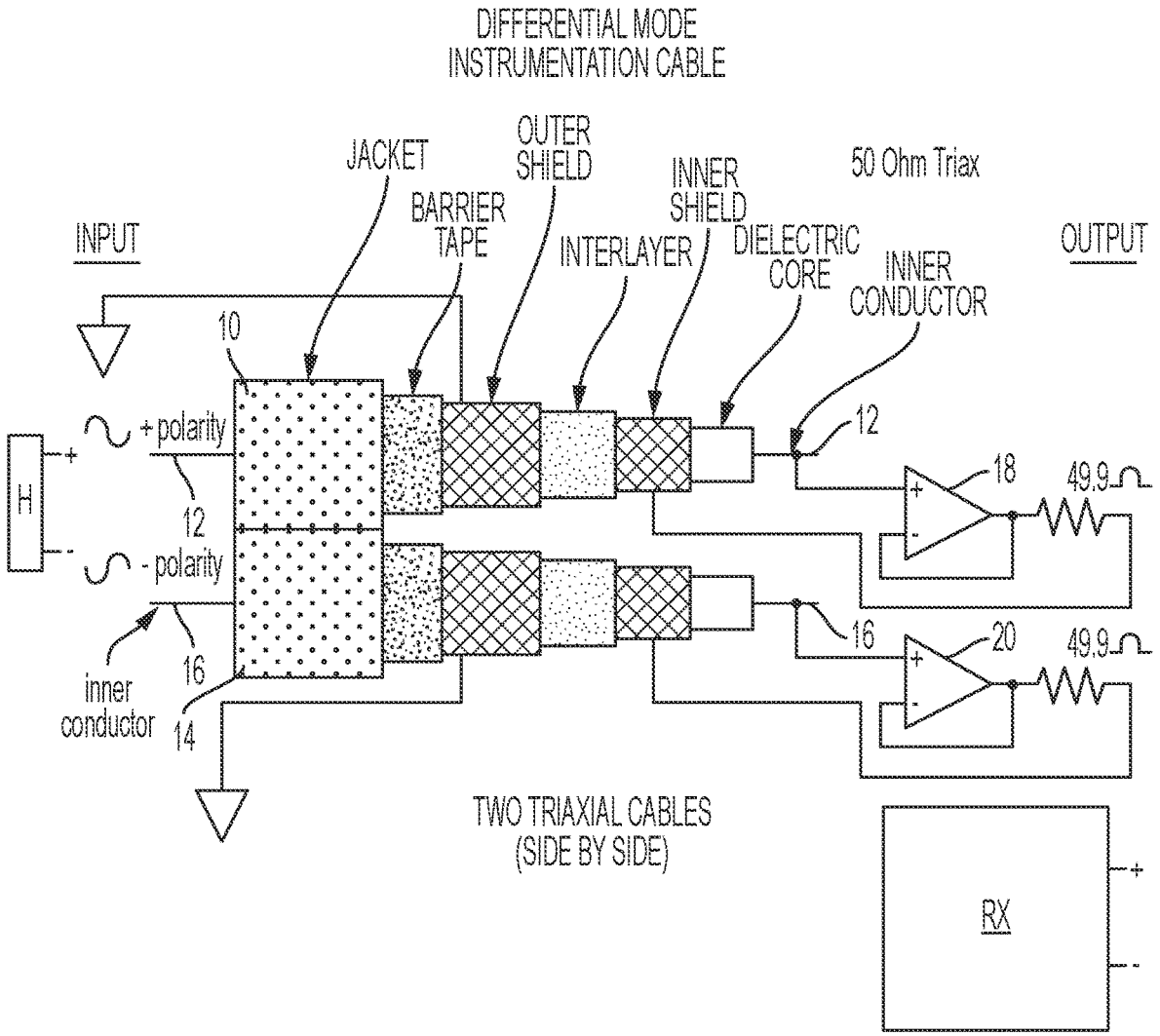
FIG. 18A shows a schematic diagram of the present invention (without the hermetic water proof cable shield) of the triax cables side-by-side whose input is sourced by a sonar hydrophone (being towed behind the ship, not shown) with the invention triax cable that connects electrically the hydrophone to a ship board receiver, (not shown), and the invention that electronically connects the hydrophone output with a sonar hydrophone signal receiver aboard ship in order to get the hydrophone audio signals at high quality, eliminating strum.

Referring now to FIGS. 18 and 18A, a preferred embodiment of the invention, a differential mode instrumentation cable is shown comprising a first triaxial cable 10 and a second triaxial cable 20, positioned side-by-side. The first triaxial cable 10 and the second triaxial cable 20 positioned side-by-side will be wrapped together with a waterproof hermetic seal that would extend up to 100 meters connecting the hydrophone at one end electronically to both the first triaxial cable and the second triaxial cable and at the opposite end to the sonar audio receiver aboard ship so that the entire length of the invention cable is sealed so that it will not get water from and to end. The first and second triaxial cables 10 and 14 each include inner conductors 12 and 16 respectively, a dialectic core, an inner shield, an interlayer insulator, an outer conductive shield, barrier tape and a protective jacket.

The (center) inner conductor in each cable 12 and 16 carries the signal of interest. A second conductor (in each triaxial cable 10 and 14) is arranged as a shield around the inner conductor called the inner shield separated by a first dielectric. A semi-conductive interlayer is situated around the outer surface of the inner shield to reduce noise caused by mechanical motion of the cables' components. A third conductor is typically arranged as an additional shield (called the outer shield) situated around the inner (conductor) shield separated by a second dielectric interlayer as well. With this arrangement, a unity gain amplifier samples the signal on the center conductor for the inner conductor and drives that signal into the inner shield (second conductor or the driven shield). The outer shield (third conductor) serves as a return path for current flowing in the inner (center) conductor. The ground reference for the amplifier and signal is the third conductor.

The invention shown in FIG. 18A can be used to enhance audio signals by connecting the inner conductor at one end as input to a sonar hydrophone being towed behind the ship in the water. The hydrophone is also connected to another cable (not shown), a mechanical cable, that attaches to the towing ship, (not shown) to keep it the hydrophone firmly attached to the ship during towing. The hydrophone has two contacts, a positive polarity and a negative s polarity. On the first triaxial cable, the input hydrophone is connected to the positive polarity. The second triaxial cable inner conductor is connected to the hydrophone negative polarity. Special nautical jacks can be used connect the first and second triaxial cables to a hydrophone. The output has the inner conductors of the first triaxial cable and second triaxial cable, which can be connected ultimately to a sonar receiver aboard ship, and the electrical circuitry utilized to produce audio signals' sounds from the sonar receiver aboard ship. Differential mode instrumentation cable improvements are discussed below using a buffer circuit with each of the cables connected to different polarity signals microphone or similarly situated hydrophone.

The first and second triaxial cables 10 and 14 each show a buffer amplifier 18 and 20 for an active driven shield buffer circuit and the inner conductors 12 and 16 connected to the voltage coming out to the shield guard (inner shield) from the buffer amplifier 18 and 20 circuit. The voltage out includes a breakout resistor to each triaxial inner braid or inner shield.

The first and second triaxial cables 10 and 14, as shown in FIG. 18 each have an active driven shield buffer circuit.

Figure 19:
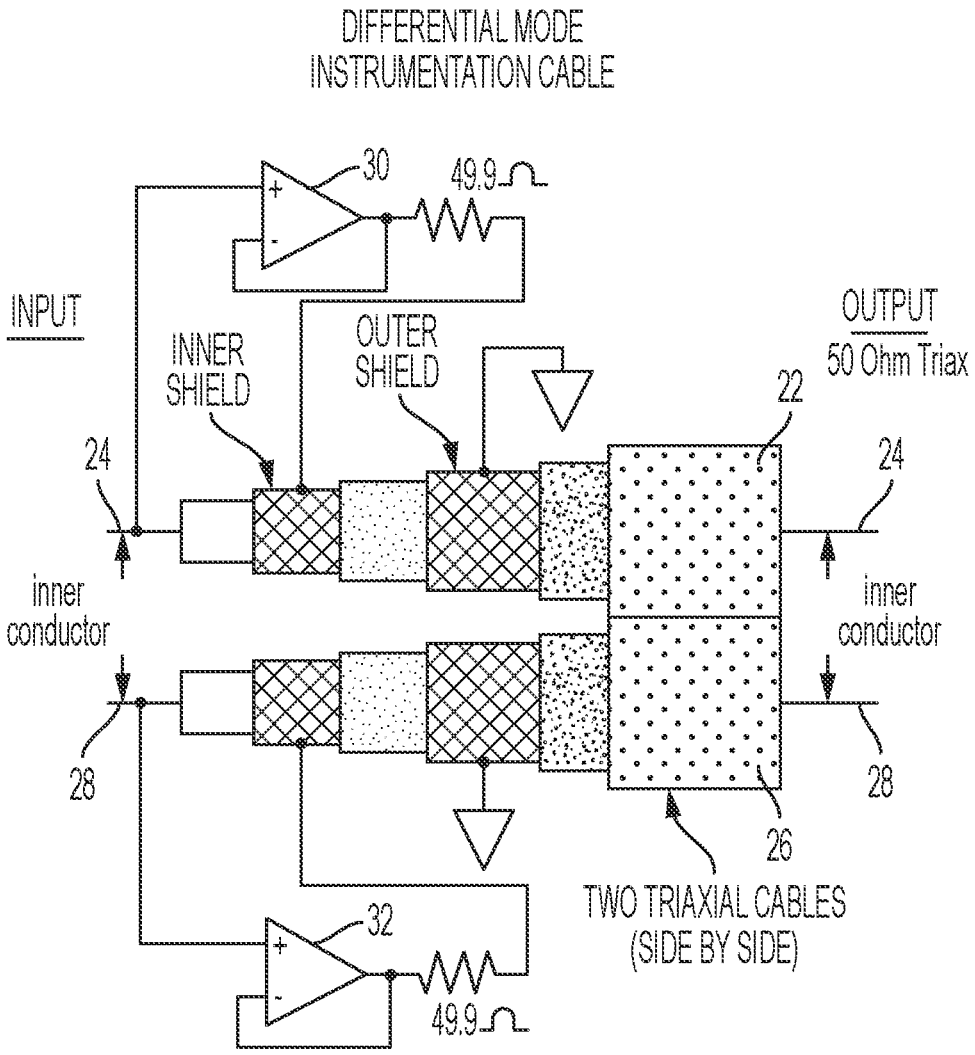
FIG. 19 shows a schematic diagram of the present invention, as the alternate embodiment, that includes two triaxial cables and the appropriate differential mode circuitry, whose input is sourced by an audio microphone pre-amplifier, and the like, and whose output is received by an audio recording console multi-track audio recording device or similar devices. The alternate embodiment can be used to receive signals from a hydrophone being towed behind the ship and provide the signals to a sonar signal receiver aboard the ship to reduce strum noise.

FIG. 19 shows an alternate embodiment of the invention; a differential mode instrumentation cable is shown comprising a first triaxial cable 22 and a second triaxial cable 26, positioned side-by-side, and wrapped in a waterproof shield the entire length from the hydrophone to the receiver aboard ship receives the sonar signals to prevent any water from getting into the first or second triaxial cables. The alternate embodiment shown in FIG. 19 is not as effective as the embodiment shown in FIG. 18A. The alternate embodiment can also be used connect a hydrophone being towed behind the ship electronically via cable up to 100 meters to a sonar audio receiver that receives the signals from the hydrophone for listening aboard ship. The first and second triaxial cables 22 and 26 each include inner conductors 24 and 28 respectively, a dialectic core, and inner shield, and interlayer insulator, and outer conductive shield, barrier tape, and a protective jacket.

The (center) inner conductor 24 and 28, respectively in each cable 22 and 26, carries the signal of interest. A second conductor (in each triaxial cable 22 and 26) is arranged as a shield around the inner conductor called the inner-shield separated by a first dielectric. A semi—conductive interlayer is situated around the outer surface of the inner shield to reduce noise caused by mechanical motion of the cables' components. A third conductor is typically arranged as an additional shield (called the outer shield) situated around the inner (conductor) shield separated by a second dielectric interlayer as well. With this arrangement, a unity gain amplifier samples the signal on the center conductor for the inner conductor and drives that signal into the inner shield (second conductor or the driven shield). The outer shield (third conductor) serves as a return path for current flowing in the inner (center) conductor. The ground reference for the amplifier and signal is the third conductor.

The invention shown in FIG. 19 can be used to enhance audio signals by connecting the inner conductor at one end as input to a hydrophone being towed behind the ship, the hydrophone has two contacts, positive polarity and a negative polarity. On the first triaxial cable, the input microphone is connected to the positive polarity. The second triaxial cable inner conductor is connected to the hydrophone negative polarity. Special nautical jacks can be used to connect the first and second triaxial cable to a hydrophone being towed. The output has the inner conductors of the first and second cable that can be connected ultimately to a hydrophone signal receiver aboard ship and the electrical circuitry utilized to produce audio signal sounds from the hydrophone receiver aboard ship. Differential mode instrumentation cable improvements are discussed below using a buffer circuit with each of the cables connected to different polarity circuit signals for a hydrophone.

The first and second triaxial cables 22 and 26 each show a buffer amplifier 30 and 32 for an active driven shield buffer circuit and the inner conductors 24 and 28 connected to the voltage coming out to the shield guard (inner shield) from the buffer amplifier 22 and 26 circuit. The voltage out includes a breakout resistor to each triaxial inner braid or inner shield.

The first and second triaxial cables 22 and 26 as shown in FIG. 19 each have an active driven shield buffer circuit.

A second embodiment regarding a speaker cable will provide a new speaker cable design, whereas a conventional lamp cord will be replaced by a differential mode instrumentation cable formed with a pair of triaxial cables, each with active driven shield buffer circuit.

The third embodiment, is with regard to a balanced/differential audiophile cable, with RCA connectors on one end and a ¼" TRS or 3 conductor XLR connector on the other end. The conventional balanced/differential audiophile cable is replaced by a triaxial cable pair, each with an active driven shield buffer circuit.

A fourth embodiment constitutes a new balanced/differential design, for guitar cables, with ¼ inch tip ring sleeve (TRS) plug and three Pin XLR connectors. The unbalanced guitar cable (single ended configuration) will be replaced with a triaxial cable pair, each with an active driven shield buffer circuit, with either a quarter inch tip, ring sleeve (TRS) plug and/or three Pin XLR connector.

A fifth embodiment utilizes analog audio balanced/differential tie lines in multi-room studios that are replaced with the same balanced/differential signaling to a triaxial cable pair, each with an active driven shield buffer circuit.

The present invention provides an unrivaled signal integrity with substantial improvements and benefits that include but are not limited to:

1. Ultra-accurate, neutral, transparent sound, (no color);
2. Increased/Optimized rise time, impulse/transient response and articulation of transmitted audio signal. Signal's musical attack will be most accurately pronounced;
3. No phase shift/group delay, in audio bandwidth of at least 100 K Hz
4. Only cable to meet Super Audio CD (SACD) frequency response specification 50 K Hz (ultra-high bandwidth)
5. 100% of signal's energy is maintained and transferred through the cable (Power Factor=1), with no (0%) signal losses, >200 K Hz bandwidth
6. No (0%) noise/noiseless cable design, to optimize signal-to-noise (S/N) cable characteristic, detail/accuracy of extremely low level audio signals are unrivaled;
7. For stereo paired audio signals, Spatial Image is ultra-stable as a function of frequency, up to a minimum of 200 K Hz, and will provide a three-dimensional aspect to the perceived sound field.
8. Cable runs (length) up to 100 meters (combining FIG. 18, 18A, and FIG. 19) will have no (0%) signal degradation.

Figure 1:
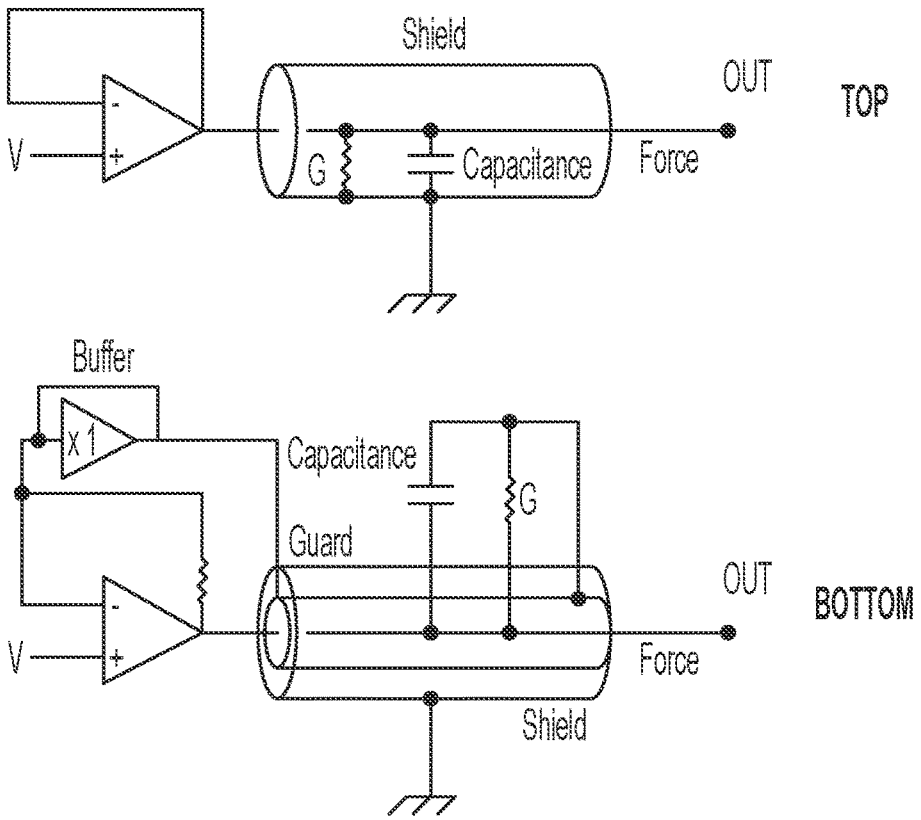
FIG. 1, top picture, shows a conventional cable that has several signal integrity issues that constitutes the prior art picture, forming a low-pass filter and dielectric absorption effects because capacitance and conductance are referenced to the shield.

FIG. 1, top picture, shows a conventional cable that has several signal integrity issues that constitute prior art picture forming a low-pass filter and dielectric absorption affects because capacitance and conductance are reference to the shield.

FIG. 1, bottom picture, shows a solution using a triaxial cable eliminating low-pass filter and by dielectric absorption affects because capacitance and conductance are reference to the guard, not the shield.

Figure 2:
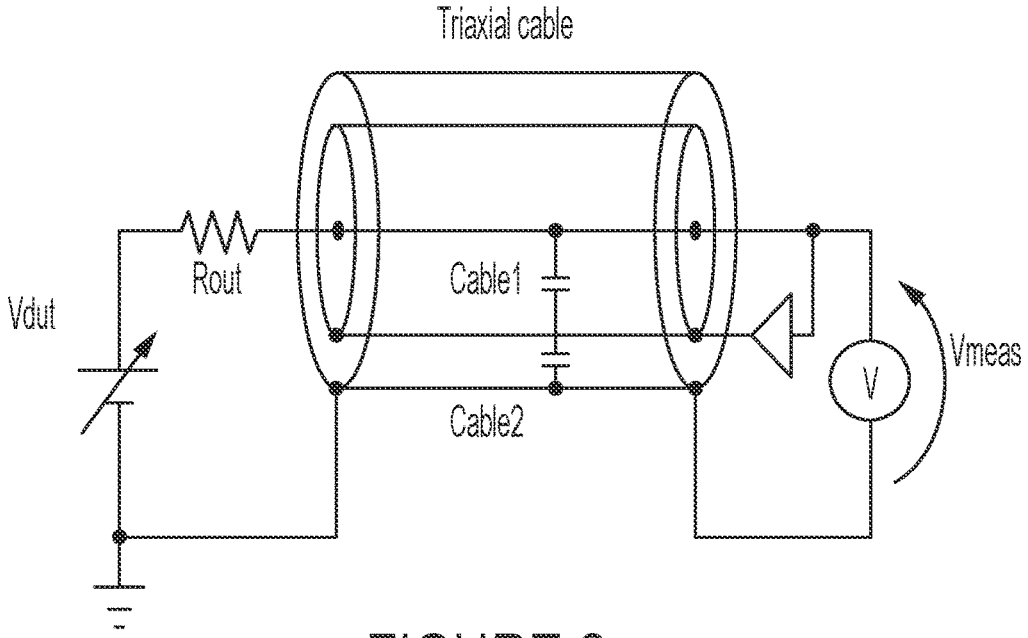
FIG. 2 shows the triaxial concept actual typology prior art, as a single ended/common mode configuration.

FIG. 2 shows the triaxial cable concept actual topology.

Figure 3:
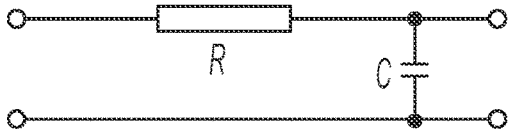
FIG. 3 shows a normal audio, microphone cable and shows cable and treble attenuation, treble cut filter, low-pass principle.

FIG. 3 shows a normal audio, microphone cable. The cable and treble attenuation trouble cut filter, low-pass, shown.

Figure 4:
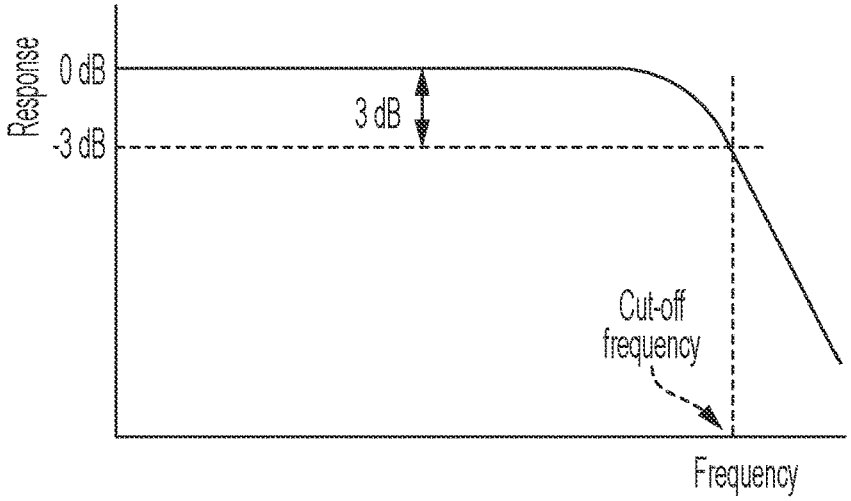
FIG. 4 shows the frequency cut off.

FIG. 4 shows the frequency cut off diagram.

Figure 5:
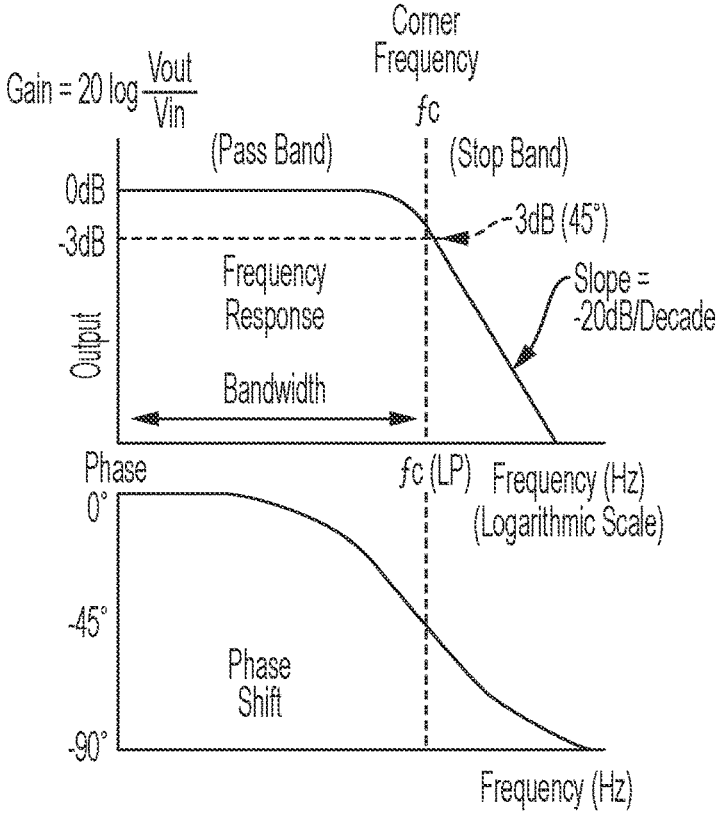
FIG. 5 shows additional details with a phase plot for frequency and output.

FIG. 5 shows additional details with a phase plot for frequency and output.

Figure 6:
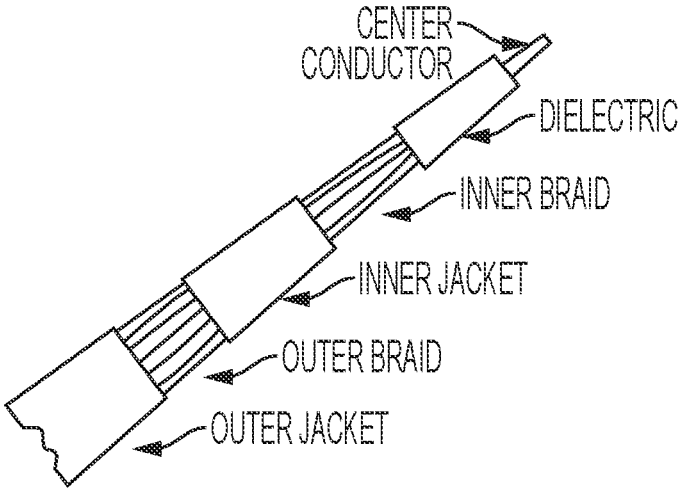
FIG. 6 shows a first embodiment regarding balance/differential signaling using XLR cable connectors.

FIG. 6 shows a triaxial cable portions cutaway show the conductive inner wire, or center conductor, inner braid guard and outer break shield.

Figure 7:
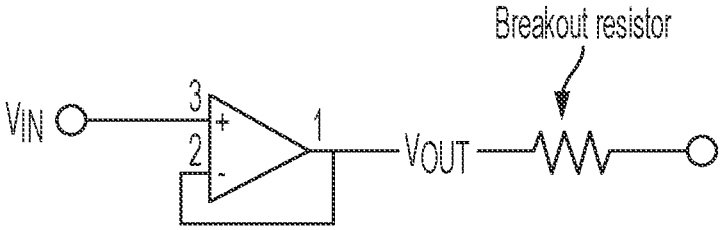
FIG. 7 shows a circuit of a driven guard with the voltage in and voltage out. This would be a wired connection for an active driven shield buffer circuit above triaxial center (inner) conductor to the voltage in and the voltage out driven guard with series breakout resistor usually 50 ohms or 75 ohms to triaxial inner (shield) braid guard. This configuration eliminates the cable capacitance and conductance. Corner frequency becomes nonexistent causing the ruler flat frequency response with ultra-wideband with frequency response.

FIG. 7 shows a circuit of a driven guard with the voltage and in voltage out. This is a wired connection for an active driven shield buffer circuit shown in FIG. 18 with the preferred embodiment, and FIG. 19 as the alternate embodiment, above the triaxial cable center or inner conductor of the voltage in voltage out driven guard with a breakout resistor to the triaxial inner braid guard. This configuration eliminates the cable capacitance and conductance. Corner frequency becomes nonexistence causing the ruler flat frequency response with ultra-wide band with frequency response.

Figure 8:
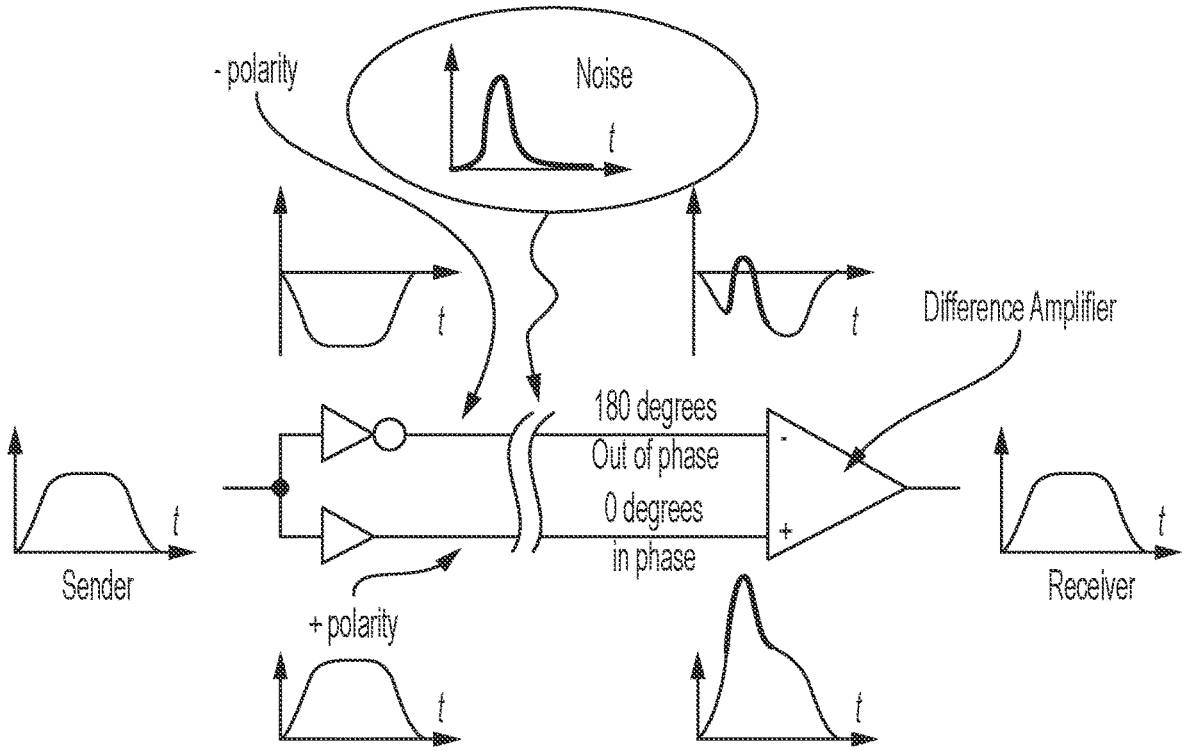
FIG. 8 shows elimination of noise by using differential signaling. Each signal depicted above will be a triaxial cable, two in total, each with an active driven shield buffer circuit.

FIG. 8 shows elimination of noise by using differential signaling that is the important part of this invention. Each signal depicted above is the first and second triaxial cables each with an active driven shield buffer circuit as shown in FIG. 18.

Figure 9:
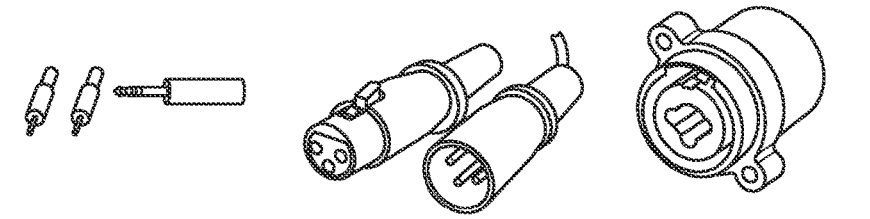
FIG. 9 shows balance/differential connections typically use shielded twisted pair cable and three conductor connectors.

FIG. 9 shows balance/differential connections, typically used, shielded twisted pair cable and three conductor connectors.

Figure 10:
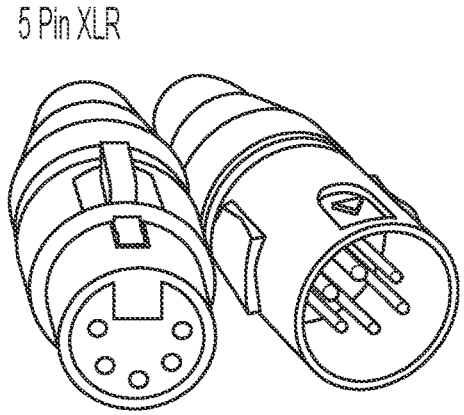
FIG. 10 shows a 5 Pin XLR and describes each of the pins. Cables mating to microphone preamplifier or instrumentation amplifier will have five pin XLR cable connectors. Opposite cable end of the five pin XLR cable connector will be conventional three pin XLR cable connector.

FIG. 10 shows a five pin XLR and describes each of the pins. Cables mating to microphone preamplifier will have five pin XLR cable connectors. Opposite end of the five pin XLR cable connector will be conventional three pin XLR cable connectors.

Figure 11:
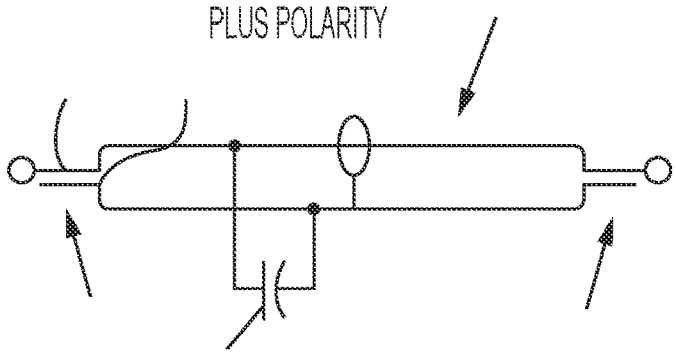
FIGURE 11 (PRIOR ART)
FIG. 11 is a sketch of a typical instrumentation cable, which is single ended configuration. The cable is comprised of lump-sum RLC circuits in series.

FIG. 11 shows a prior art typical instrumentation cable which is single ended configuration. Cable is comprised of lump-sum RLC circuits in series.

Figure 12:
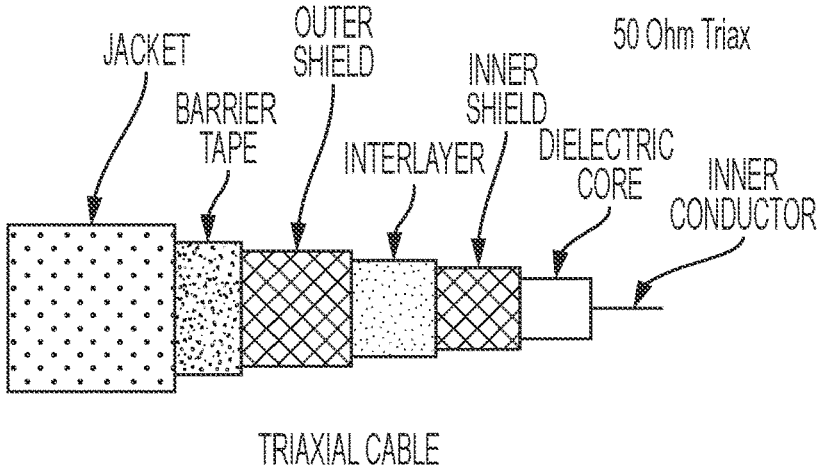
FIG. 12 depicts the component breakdown of a triaxial cable.

FIG. 12 shows a schematic diagram of a triaxial cable broken down to show the individual components. The triaxial cable shown is similar to one shown in FIG. 18.

Figure 13:
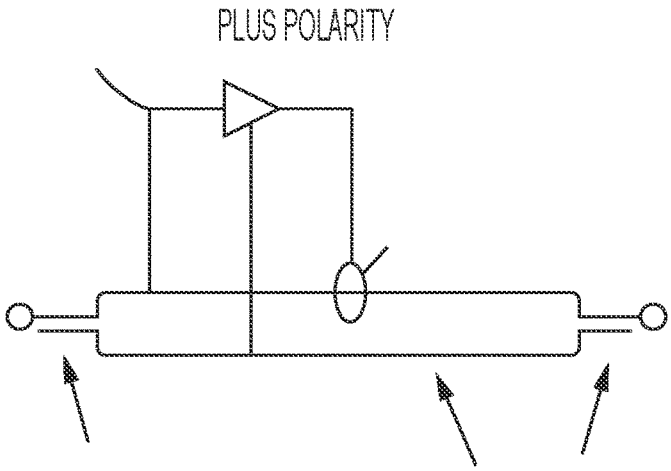
FIGURE 13 (PRIOR ART)
FIG. 13 is a schematic representation of the equivalent circuit of FIG. 11, as a triaxial cable with an active driven shield circuit prior art.

FIG. 13 is a schematic representation of the equivalent circuit of FIG. 11 as a triaxial cable within active driven shield circuit.

Figure 14:
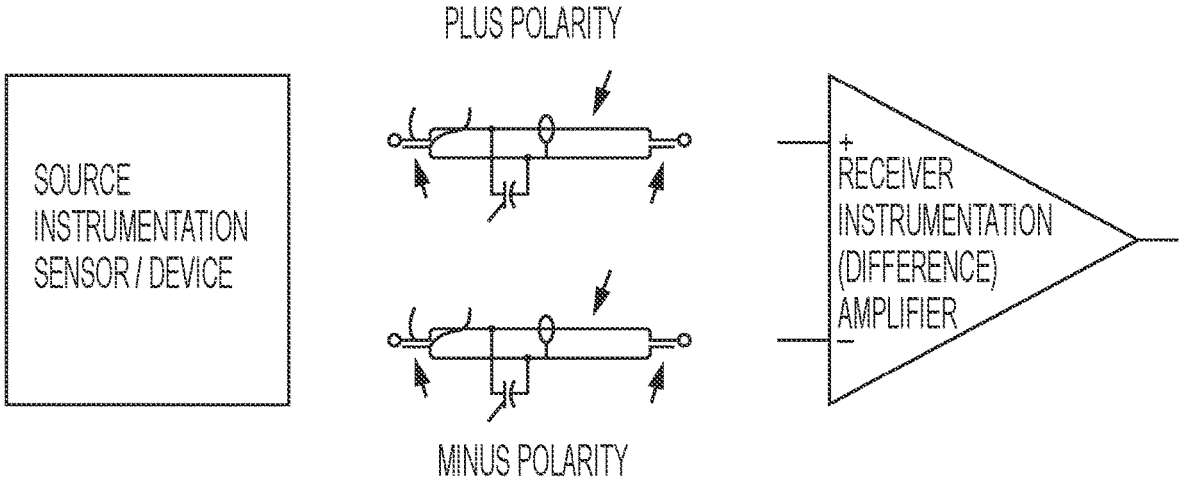
FIGURE 14 (PRIOR ART)
FIG. 14 depicts the signal transference of conventional instrumentation cable, is a differential mode configuration.

FIG. 14 depicts the signal transference of conventional instrumental cable as a differential mode configuration.

Figure 15:
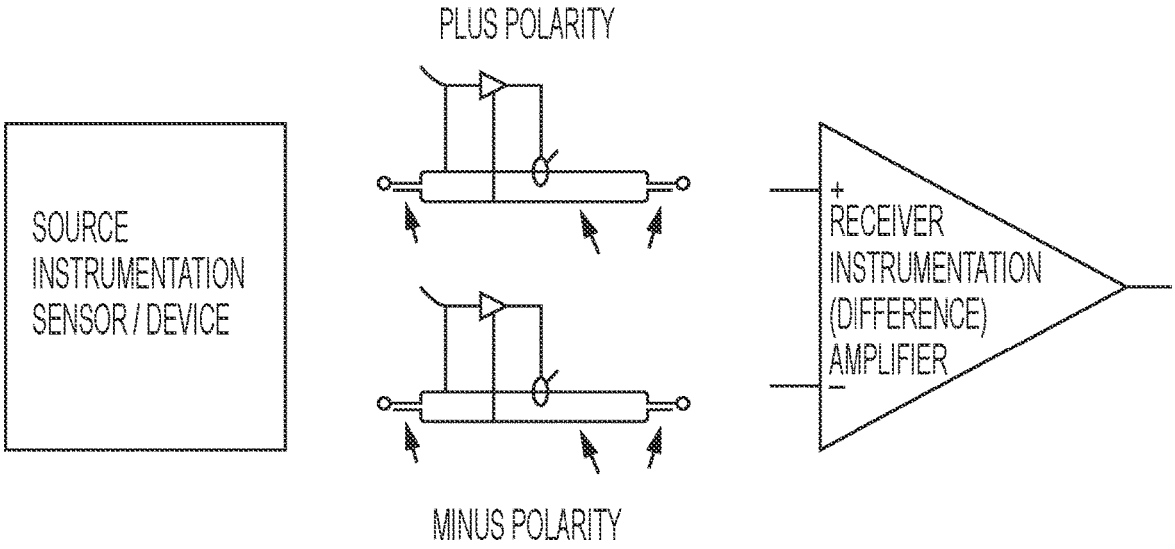
FIG. 15 is a combination of FIG. 13 and FIG. 14, and depicts a unique design as the signal transference of a triaxial pair of cables, each with an active driven shield circuit, as a differential mode configuration, for low signal levels.

FIG. 15 is a combination of FIG. 13 and FIG. 14 depicts a unique design as the signal transference of a triaxial pair each with an active driven shield circuit as a differential mode configuration for low signal levels.

Figure 16:
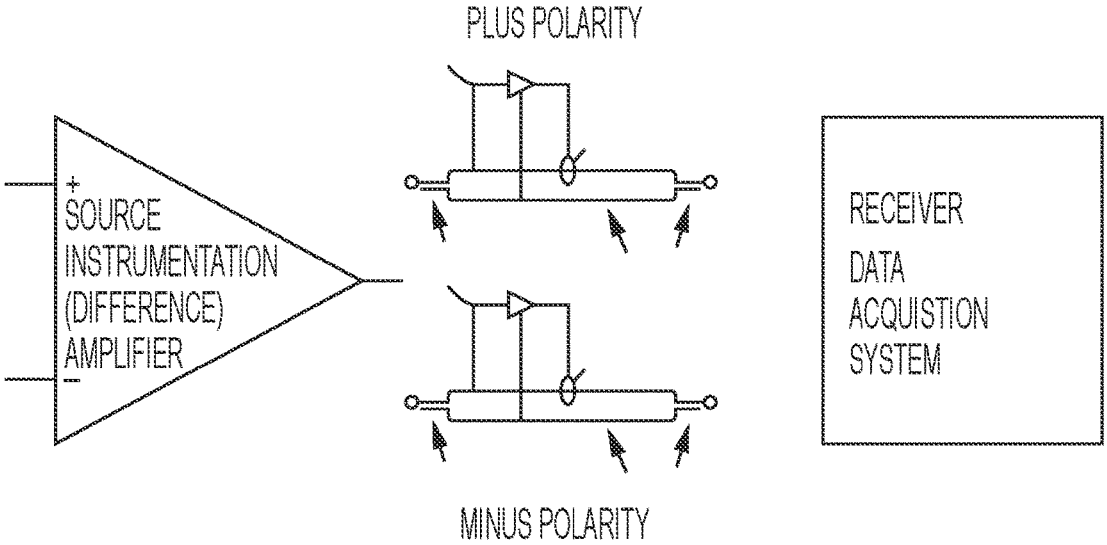
FIG. 16 is a combination of FIG. 13 and FIG. 14, and depicts a unique design as the signal transference of a triaxial pair, each with an active driven shield circuit, as a differential mode configuration, for high signal levels.

FIG. 16 is a combination of FIG. 13 and FIG. 14 and depicts a unique design as the signal transference of the triaxial pair of cables each with an active driven shield circuit as a differential mode configuration for high signal levels.

Figure 17:
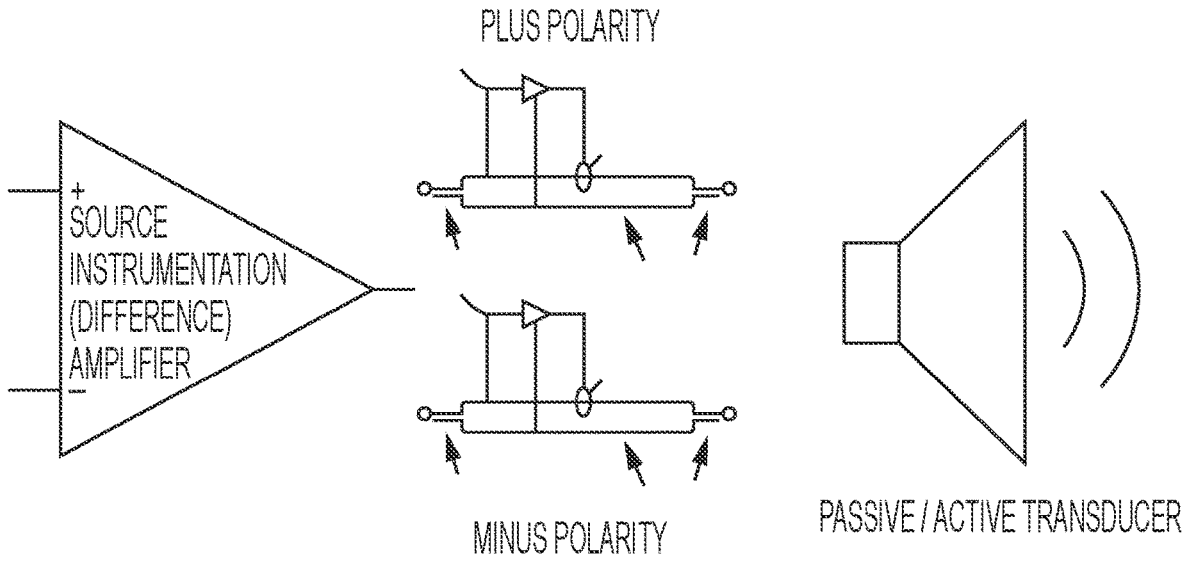
FIG. 17 is a combination of FIG. 13 FIG. 14, and depicts a unique design as the signal transference of a triaxial pair of cables, each with an active driven shield circuit, as a differential mode configuration, for power signal levels.

FIG. 17 is a combination of FIG. 13 FIG. 14 depicts a unique design as the signal transference of a triaxial pair, each with an active driven shield circuit, as a differential mode configuration, for power signal levels.

FIG. 18 shows the differential mode instrumentation cable that constitutes the invention described herein.

FIG. 18A shows the primary invention for microphone toad ship capture phone signals transferred to phone signal received ship to reduce strum noise.

FIG. 19 shows the differential mode instrumentation cable that constitutes the invention described herein, as the alternate embodiment, but not as effective as the embodiment shown in FIG. 18A.

Active driven shield circuitry can be located and is functional at either end of a custom triaxial cable assembly. The location of the circuit is most preferred at the load side (not the source) of the triaxial cable pair.

Signal transference, with differential mode configuration, as a positive and negative signal polarity. This configuration can differentiate the signal (differential mode) from the noise (common mode interference).

The difference amplifiers at the load and (receiver input circuit) of the differential signal pair. Difference amplifier passes the differential signals through unaltered, except for gain, whereas the common mode signals (noise/interference) are subtracted (removed/rejected) by the difference amplifier.

The invention claimed is:

1. A differential mode cable for improving the signal integrity of audio sonar hydrophone signals being sent to a shipboard microphone signal receiver, while being towed in the water, including the use of hydrophone signal sensors and transducers comprising:

first triaxial cable and a second triaxial cable positioned side-by-side and wrapped in a waterproof cable housing, from and to end, between a hydrophone being towed in water and a hydrophone signal receiver aboard ship, to prevent any water from touching the first triaxial cable and the second triaxial cable, the first triaxial cable and said second triaxial cable each having an inner conductor and each having a first end and a second end; said first triaxial cable and said second triaxial cable connected electrically to the output of a hydrophone being towed in the water there first ends connected to a hydrophone signal receiver aboard ship electrically at their second ends;

said first triaxial cable inner conductor and said second triaxial cable conductor each having an inner shield surrounding conductor having a first end and a second end; separated by dielectric core first dielectric there from;

said first triaxial cable and said second triaxial cable each having a third conductor, each having a first end and a second end, situated external to said second shield conductor, separated by a second dielectric therefrom;

said first triaxial cable and said second try cable having overall insulating layer;

said first triaxial cable and said second each first inner connector having at least a signal terminal and a shield terminal with said first end of said first inner conductor connected to said signal terminal, and with said first end of said third conductor connected to said shield terminal;

said first triaxial cable and said second track cable each having a second connector having at least a signal terminal and a shield terminal with said second end of said first conductor connected to said signal terminal and with said second end of said third conductor connected to said shield terminal; and said first triaxial cable and said second try cable each having an electronic amplifier whose input is connected to said first inner conductor and whose output is connected to said second shield conductor, said electronic amplifier having unity gain that neutralizes the interelectrode capacitance between said first inner conductor and said third conductor of first and second triaxial cables forming said instrumentation cable.

2. A method of improving the signal integrity of audio sonar signals from a sonar hydrophone being towed in the water behind the ship to a sonar signal receiver located aboard ship for listening to the sonar signals from the hydrophone, neutralizing interelectrode capacitance and elimination of towing cable strum comprising the steps of:

a) providing a differential mode cable, (with a positive and negative polarity pair) that includes a first triaxial cable and a second triaxial cable positioned next to said first triaxial cable; said first triaxial cable and said second triaxial cable connected at one end to said hydrophone output while being towed through the water connected at said second and to a hydrophone signal receiver aboard ship to reduce strum noise;

b) wrapping said first triaxial cable and said second triaxial cable positioned together with a waterproof cable covering from end to end of said first and second triaxial cables, including from a hydrophone connected at one end and a sonar signal hydrophone receiver located aboard ship at the other end, to keep the first triaxial cable and the second triaxial cable waterproof;

c) providing said first triaxial cable and said second triaxial cable, each having an inner conductor, a second shield conductor disposed around said inner conductor, separated by a first dielectric therefrom, and third conductor situated external to said second shield conductor, separated by a second dielectric therefrom, and an overall insulating layer; and d) providing a unity gain electronic amplifier, for each polarity, for said first triaxial cable inner conductor and said second triaxial cable inner conductor, said unity gain electronic amplifier input being connected to said first triaxial cable inner conductor and whose output is connected to said second shield conductor, said electronic amplifier is unity gain, said second capacitance being the characteristic said inter electrode capacitance of said instrumentation cable.

3. A differential mode instrumentation cable to connect the output of a sonar hydrophone, throughout the entire signal chain, to the input of sonar hydrophone signal receiver mounted aboard ship while neutralizing the interelectrode capacitance and elimination of mechanical cable Strom connecting a hydrophone to a ship comprising:

a first triaxial cable, having an inner conductor, surrounded by an inner shield in a dialectic core, that includes a buffer (unity gain) amplifier, connected to the inner conductor and the inner shield; and a second triaxial cable, having an inner conductor, surrounded by an inner shield and a dialectic core, that includes a buffer (unity gain) amplifier, connected to the inner conductor in the inner shield; said first triaxial cable and said second triaxial cable mounted together side-by-side and surrounded and closed in a waterproof cable housing from end to end;

whereby the cable capacitance reduction circuits use a unity gain amplifier drive the first and second triaxial cable inner shields.

* * * * *